US005474671A

United States Patent [19]

O'Connor

[11] Patent Number: 5,474,671

[45] Date of Patent: Dec. 12, 1995

[54] PROCESS FOR REMOVING OIL FROM LIQUEFIED PETROLEUM GAS

[75] Inventor: John W. O'Connor, Bartlesville, Okla.

[73] Assignee: Phillips Petroleum Company, Bartlesville, Okla.

[21] Appl. No.: 226,151

[22] Filed: Apr. 11, 1994

[51] Int. Cl.[6] ..... C07C 7/12; C10G 25/00

[52] U.S. Cl. ..... 208/299; 208/307; 585/820; 585/823; 585/951; 502/416; 502/514

[58] Field of Search ..... 208/299, 307, 208/310 R; 585/820, 823, 951; 502/416, 514

[56] References Cited

U.S. PATENT DOCUMENTS

| | | | |
|---|---|---|---|
| 3,051,649 | 8/1962 | Legatski | 208/299 |
| 3,310,595 | 3/1967 | Molinet | 585/823 |
| 3,944,501 | 3/1976 | Whitehurst et al. | 252/182 |
| 4,381,929 | 5/1983 | Mizuno et al. | 55/316 |
| 5,125,385 | 6/1992 | Finzel | 123/698 |
| 5,129,926 | 7/1992 | Harwell | 55/255 |
| 5,143,041 | 9/1992 | Franzke | 123/520 |

OTHER PUBLICATIONS

McGraw–Hill Encyclopedia of Science and Technology, 6th Ed., 1987, pp. 99–100 "Activated Carbon".

Encyclopedia of Chemical Processing and Design, 1988, vol. 6, pp. 110–145, "Carbon Activated".

Encyclopedia of Chemical Processing and Design, 1978, vol. 28, pp. 222–261, "Liquefied Petroleum Gas".

Kirk–Othmer Encyclopedia of Chemical Technology, 3rd Ed., 1981, vol. 14, pp. 383–395, "Liquefied Petroleum Gas".

*Primary Examiner*—Asok Pal
*Assistant Examiner*—Walter D. Griffin
*Attorney, Agent, or Firm*—Gary L. Haag

[57] ABSTRACT

This invention concerns a process and apparatus for removing oil from liquefied petroleum gases. In a preferred embodiment, the activated carbon bed is pretreated with odorant thereby enabling oil to be removed from odorized liquefied petroleum gases with negligible removal of odorant.

5 Claims, 2 Drawing Sheets

PROCESS FOR REMOVING OIL FROM LIQUEFIED PETROLEUM GAS

This invention relates to a process and apparatus for removing oil from liquefied petroleum gas.

The utilization of liquefied petroleum gas (LPG), also referred in the trade as LP-gas or propane, as a motor fuel required improvements in fuel quality brought about by the elimination or reduction of contaminants, and improvements in compositional purity. This was primarily accomplished through the development of HD-5 grade propane which is now generally accepted by the propane industry as the standard for motor fuel applications. One problem still persists, that is the presence of trace levels of oily residue picked up by the LP-gas in the product transportation system.

In a typical fuel system, liquefied petroleum gas is delivered from the storage tank to the converter, also referred to as the evaporator/regulator, where the converter functions as a heat exchanger using engine heat either directly or from the cooling system to convert the liquid LPG to a gas. Although the liquefied petroleum gas is easily vaporized, trace amounts of oil present in the liquefied petroleum gas are generally left behind in the converter as a liquid. As the deposit of oily residue builds up over time through the use of many gallons of propane, the efficiency of the pressure regulators, particularly the secondary regulator, are reduced thereby resulting in sluggish operation, poor starting and poor idling. The oily residue has been characterized as being rich in $C_{11}$ through $C_{33}$ paraffins.

As the oil collects in the converter, it often acts as a binder for very small solid particles which can also be suspended in the liquefied petroleum gas. This combination of solid matter and oil can form a thick, gooey paste which can seriously affect the operation of key components in the converter, particularly the delicate regulators.

The oil found in liquefied petroleum gas is generally an accumulation of oil consumed by the equipment used to move the liquefied petroleum gas. Compressors, lubricated plug valves, some pumps, and certain hoses through which the liquefied petroleum gas flows are among the possible sources of oil contamination. The majority of the oil consumed by liquefied petroleum gas compressors ends up in the liquefied petroleum gas system somewhere. Lubricated plug valves contribute oil to the flowing liquefied petroleum gas by the extraction of oil from the grease used to lubricate the valves. Likewise, the liquefied petroleum gas will extract oil from the rubber liners in hoses. Therefore by the time the liquefied petroleum gas reaches the fuel system of a liquefied petroleum gas fueled engine, the liquefied petroleum gas may be contaminated with trace amounts of oil even though it left the producing plant virtually oil-free.

Because liquefied petroleum gas is nearly odorless and is very flammable, an odorant such as ethyl mercaptan or tetrahydrothiophene is generally added for safety considerations. Therefore, it is highly desirable that any process which is employed to remove residual oil from liquefied petroleum gas not have a significant effect on the odorant concentration in the liquefied petroleum gas. Among the ways the odorant concentration may be affected by the process are the various means of sorption, that is absorption, adsorption and chemisorption; direct or catalyzed reaction of odorant with chemical species employed in the process; and reaction of the odorant with itself facilitated by process conditions such as temperature, pressure and availability of catalytic reaction sites.

SUMMARY OF THE INVENTION

It is an object of this invention to develop a process and an apparatus for removing oil from liquefied petroleum gases.

It is a further object of this invention to develop a process and apparatus for removing oil from odorized liquefied petroleum gases without substantially affecting the concentration of odorant in the liquefied petroleum gas.

It is yet a further object of this invention to develop a process and apparatus for use in the fuel system of a liquefied petroleum gas-powered vehicle for the removal of oil present in the liquefied petroleum gas.

And it is yet a further object of this invention to develop a process for removing oil from odorized liquefied petroleum gas at fueling stations for mobile liquefied petroleum gas-powered vehicles without substantially affecting the final odorant concentration in the fuel.

In accordance with this invention, a process has been developed for the removal of oil from liquefied petroleum gases wherein said process comprises contacting the oil-bearing liquefied petroleum gas with activated carbon.

In another embodiment of this invention, a process has been developed for the removal of oil in odorized liquefied petroleum gas comprising contacting the odorized oil-bearing liquefied petroleum gas with activated carbon which has been pretreated with odorant.

In yet another embodiment of this invention, an inventive apparatus has been developed comprised of a container, activated carbon situated in the container, a means of introducing liquefied petroleum gas to the container, a means for removing liquefied petroleum gas from the container situated opposite to said introducing means and wherein said activated carbon is located between said introducing means and said removing means.

In still yet another embodiment of this invention, the inventive apparatus comprises a container, an odorized activated carbon located in said container, a means of introducing the liquefied petroleum gas into the container, and a means for removing the liquefied petroleum gas from the container which is located opposite of said introducing means and wherein said odorized activated carbon is located between said introducing means and removing means.

BRIEF DESCRIPTION OF THE DRAWINGS

A better understanding of the invention will be obtained upon reference to the accompanying drawings of which.

DETAILED DESCRIPTION OF THE INVENTION

Figure 1:
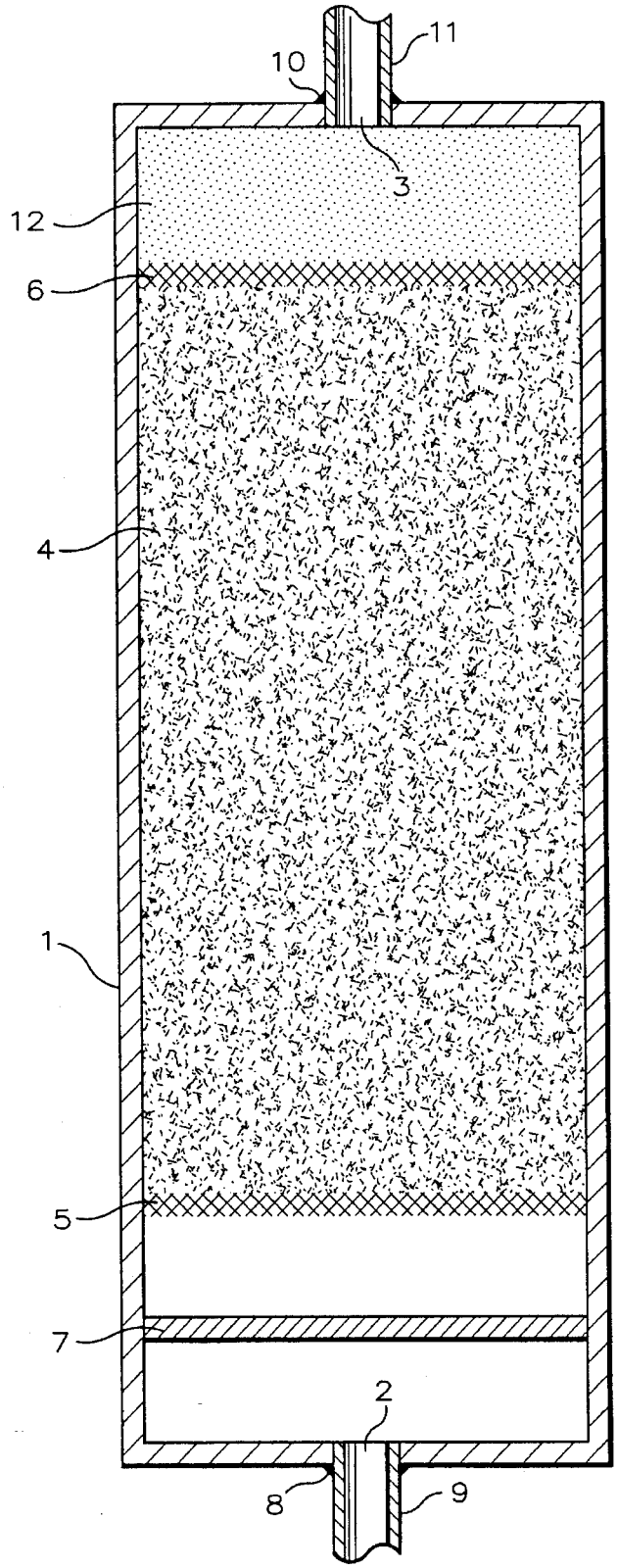
FIG. 1 is a cross-sectional view of one embodiment of the apparatus which contains a fixed bed of activated carbon.

The present inventive process and apparatus is applicable for removing oil from liquefied petroleum gases. Liquefied petroleum gases are comprised primarily of propane and lesser amounts of propylene and butane. Based on end usage, commercial standards have been developed for propylene content, vapor pressure and other key physical properties. Because of the high percentage of the chemical species, propane, in liquefied petroleum gases, these liquids are frequently referred to in a generic manner as propane. Although the desired concentration of oil in delivered liquefied petroleum gases is zero, oil concentrations of 0.005 to 0.015 g/gal are frequently observed.

The inventions herein disclosed are particularly applicable for the treatment of liquefied petroleum gases intended for use as motor or motor vehicle fuel. More specifically, the inventions herein disclose a process and an apparatus for removing residual oil from the liquefied petroleum gas fuel prior to flowing the fuel through the engine fuel system converter or evaporator/regulator where the fuel is converted from a liquid to a gas. This removal can occur by placing the oil removal process and apparatus between the fuel dispenser tank and the motor fuel tank thereby removing the oil from the liquefied petroleum gas while filling the motor fuel tank and/or placing the oil removal process and apparatus in the engine fuel system between the motor fuel tank and the converter. In the former application, the apparatus and process must be sized to provide an adequate fill rate during refueling and must result in negligible net removal of odorant from the liquefied petroleum gas. Because liquefied petroleum gas is nearly odorless, the presence of odorant, most notably ethyl mercaptan or tetrahydrothiophene, is required because of safety considerations. In the latter application wherein the oil removal process and apparatus are located in the fuel system between the motor fitel tank and the converter, the size of the apparatus is greatly reduced by the reduced flow rate and the net volume of liquefied petroleum gas requiring treatment. Again, it is desirable that the process and apparatus result in negligible net removal of odorant from the liquefied petroleum gas.

A key inventive feature of this invention is the use of activated carbon for effectively removing oil from liquefied petroleum gas. By doing so, numerous problems associated with the use of liquefied petroleum gas which have plagued the industry for decades are avoided. A second inventive aspect of this invention present in some, but not all, embodiments is the pretreatment of the activated carbon with odorant. Preferably, the pretreatment is with an effective amount of odorant such that the resulting odorized activated carbon will remove negligible odorant from the liquefied petroleum gas during the treatment process. Odorants which have been used commercially in liquefied petroleum gases are ethyl mercaptan and tetrahydrothiophene. Ethyl mercaptan is most preferred. Wishing not to be bound by theory, the pretreatment process apparently reduces the capacity of the bed to adsorb or chemisorb odorant and also apparently poisons catalytic sites which facilitate oxidation of the odorant, particularly ethyl mercaptan.

The activated carbon employed in the various embodiments may have been prepared using either chemical or thermal activation processes. The carbon source is generally selected from the group consisting of wood, peat, lignite, bone, nut shells, coal and petroleum coke. Thermal activation is preferred. Activated carbons developed for liquid phase applications (i.e., liquid-phase carbons) are generally preferred because they possess a pore size distribution more amenable to the treatment of liquids than do the vapor-phase carbons. A preferred granular activated carbon is 4×14 mesh Westvaco Nuchar WV-B.

The liquefied petroleum gas is contacted with the activated carbon or odorized activated carbon, preferably in a fixed bed, a moving bed, or a fluidized bed. Most preferred are fixed beds because of their simplicity and ease of continuous operation. Fixed beds are relatively compact and provide a means for efficiently utilizing the sorption capacity and removal efficiency of the activated carbon. The most preferred fixed bed geometry is cylindrical with flow into and out of the circular faces. The activated carbon may be either pulverized or granular. For the preferred fixed bed applications, granular is preferred. Preferred particle sizes are 4×14 to 20×50 mesh Tyler equivalent. Flow rate fluxes and residence times in the fixed beds are dependent on bed depth and the concentration of oil in the liquefied petroleum gas. Desired flow rate fluxes and residence times are those effective to obtain an acceptable concentration of residual oil in the effluent from the perspective of one skilled in the art. A flow rate of less than about 75 gal/hr $ft^2$, where $ft^2$ is based on the reactor cross-sectional area perpendicular to flow, is preferred. A flow rate of less than about 40 gal/hr $ft^2$ is more preferred. Residence times based on the entire bed volume (i.e., not based on void volume) of at least about 0.25 hour are preferred and at least about 2.5 hours more preferred. For cylindrical bed geometries, a bed length to diameter ratio of at least about 4 to 1 is preferred.

The process may additionally be comprised of a dispersing or distributing step prior to contacting the liquefied petroleum gas with the fixed bed. This step is conducted to ensure a more uniform fluid flow distribution into and within the bed thereby reducing the likelihood of channelling or non-uniform flow through the bed. The bed may also contain internal baffles to improve liquid/solid contacting. A filtering step located downstream of the fixed bed may also be employed for the removal of water and/or solid particulates such as activated carbon fines and rust.

In another embodiment, the process may additionally comprise an initial step wherein activated carbon, preferably present in a fixed bed, is contacted with odorant in a concentration effective to insure negligible removal of odorant when the bed is subsequently contacted with an odorized oil-bearing liquefied petroleum gas. This fixed bed may function as an activated carbon source for beds employed in the treatment of oil-bearing liquefied petroleum gases or the bed in its entirety may be employed in the subsequent treatment of an oil-bearing liquefied petroleum gas.

An important factor in the operation of the process is the start-up procedure and more specifically, the manner in which the activated carbon is transitioned from an air environment to a liquefied petroleum gas environment. Because of the presence of water in air, the possible sorption of water by activated carbon, and the significant reduction in temperature when liquefied petroleum gas is flashed to the gaseous state, blockage of the activated carbon bed by the freezing of water is possible when displacing air from the activated carbon with liquefied petroleum gas. To avoid this problem, a start-up procedure has been developed. The initial step comprises contacting at least in part the air- and moisture-exposed activated carbon with anhydrous methanol. The methanol apparently functions as a water absorbent and antifreeze thereby reducing the likelihood of water freezing in the bed. In the next step, the majority of the air is displaced from the activated carbon by liquefied petroleum gas which has been flashed to a gaseous state and injected into the bed. The system is then pressured up such that the majority of the petroleum gas therein exists in the liquid state. The majority of the methanol and water is then displaced from the bed in the liquefied petroleum gas by injecting additional liquefied petroleum gas.

Referring to the apparatus disclosed in FIG. 1, this figure presents a schematic sketch of one embodiment of the inventive apparatus. The inventive apparatus comprises a pressure vessel 1, designed for liquefied petroleum gas service and preferably cylindrical in geometry, having at least one first aperture 2 for fluid flow into the container and at least one second aperture 3 for fluid flow from the container. In one preferred embodiment, the pressure vessel is comprised of a pipe with threaded end caps or plugs and the threaded end caps or plugs are screwed onto or into the pipe. Apertures 2 and 3 are single holes in each end cap which are tapped for pipe threads. In another preferred embodiment, the pressure vessel is comprised of a pipe to which flanges have been attached to each end. The flanges are then bolted to endplates which contain apertures 2 and 3 which are tapped for pipe threads.

Located between apertures 2 and 3 is a fixed bed of activated carbon 4. In one preferred embodiment, the activated carbon has been treated with an odorant to become an odorized activated charcoal. The activated carbon 4 is situated between a permeable means for supporting the bed 5 which is located between the inlet aperture 2 and bed 4. The apparatus may optionally be comprised of a permeable means for containing the bed 6 which is located between the bed 4 and outlet aperture 3. The permeable supporting means 5 and permeable containing means 6 are comprised in whole or in part of a permeable material or arrangement of items resulting in a permeable matrix. Examples of the former include sintered porous plates, screens and perforated plates. Examples of the latter include the use of various packings such as fiber and beads, screens and perforated plates. Candidate materials of construction for either include but are not limited to plastic, glass and metal. The permeable supporting and containing means may cover the entire cross-section of the container as shown in FIG. 1 or may cover one or both of the apertures. The apparatus may optionally include a means for distributing 7 the liquefied petroleum gas across the cross-section available to flow prior to contacting the bed so as to insure more uniform flow of the fluid through the bed. Depending on apparatus design and flow rate, this means may function to redirect the momentum of the entering fluid prior to contacting the bed (ex., a flow deflector plate) or to provide sufficient upstream pressure drop to insure near uniform flow of fluid into the bed (ex., sintered metal plate). The means for supporting and means for distributing may be physically combined.

The inventive apparatus additionally comprises a means for connecting 8 at least one first conduit 9 to the pressure vessel 1 at said at least one first aperture 2 and a means for connecting 10 at least one second conduit 11 to the pressure vessel 1 at said at least one second aperture 3. The means for connecting include those means readily available to individuals skilled in the art. Preferred connections are welded connections and threaded connections. The apparatus may additionally contain a filter medium 12 for the removal of water and/or various suspended particulates such as rust and activated carbon from the treated liquefied petroleum gas or treated odorized liquefied petroleum gas. This medium may be located either between the activated carbon bed 4 and aperture 3, the activated carbon bed and the optional outlet permeable containing means 6, or between the optional outlet permeable containing means 6 and the aperture 3 as shown in FIG. 1. The filter medium may be comprised of any high efficiency filter material. Suitable filter mediums include porous metal, paper, and cloth. The medium may additionally contain a water sorbent such as molecular sieves or calcium sulfate.

The apparatus may optionally contain a means for accessing the interior of the pressure vessel for the removal or replacement of various internal elements such as the activated carbon, the filter media, the means for containing, the means for supporting and the means for distributing. One preferred embodiment employing this element was previously discussed. In this embodiment, the pressure vessel is nominally comprised of a pipe with threaded ends and threaded end caps or plugs are screwed onto or into the pipe. Apertures 2 and 3 are holes drilled into the respective end caps and plugs which are tapped for connection with conduits 9 and 11. Access to the interior of the pressure vessel is made possible by removing an end cap or plug.

Although not illustrated in FIG. 1, the apparatus may optionally contain internal baffles located within the activated carbon bed. These baffles help insure efficient contacting of the liquefied petroleum gas with the fixed bed 4. The preferred orientation of the apparatus is such that bulk fluid flow through the bed is either vertically upward or downward.

Figure 2:
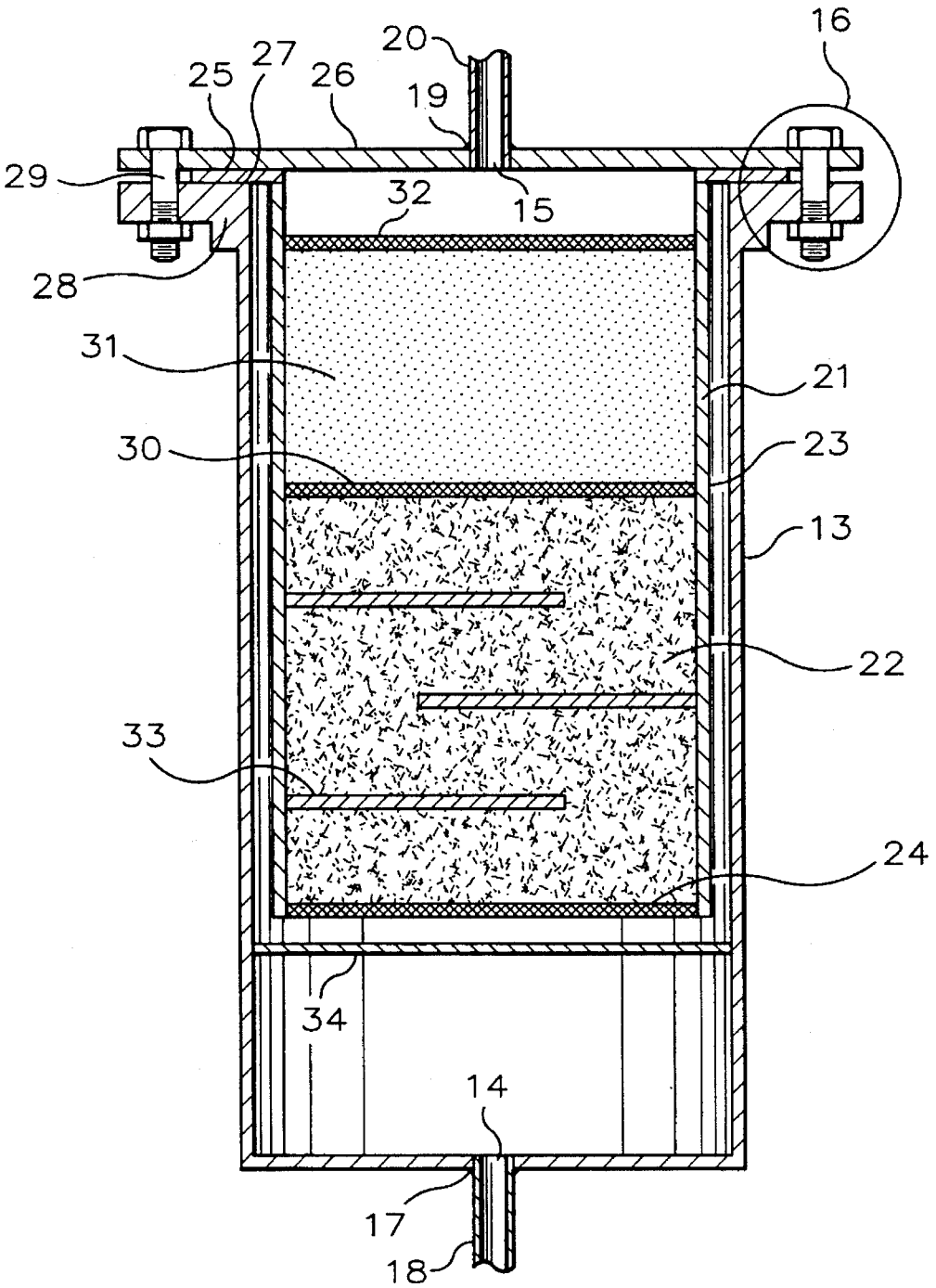
FIG. 2 is a cross-section view of another embodiment of the invention wherein the fixed bed of activated carbon is situated in a removable canister.

In FIG. 2, a schematic sketch of another embodiment of a canister-bearing inventive apparatus is presented. The apparatus comprises a pressure vessel 13 designed for continuous service with liquefied petroleum gases and preferably cylindrical in geometry, having at least one first aperture 14, at least one second aperture 15 and a means for accessing 16 the internals of the pressure vessel for the removal of various elements located therein, particularly a canister and the elements contained therein; a means for connecting 17 at least one first conduit 18 to the pressure vessel 13 at the at least one first aperture 14 and a means for connecting 19 at least one second conduit 20 to the pressure vessel 13 at the at least one second aperture 15; and a removable canister 21 containing activated carbon 22, more preferably odorized activated carbon. The means for respectively connecting the at least one conduits 18 and 20 to the at least one apertures 14 and 15 on the pressure vessel 13 are analogous in function and structure to elements 8 and 10 previously disclosed in the discussion of FIG. 1 elements.

The removable canister 21 containing activated carbon 22 functions as a conduit for the flow of liquefied petroleum gas through the bed of activated carbon. The perimeter canister walls 23 are impermeable to fluid flow. The canister is preferably cylindrical. The end of the canister in closest proximity to the at least one second conduit 20 is open. The end of the canister in closest proximity to the at least one first aperture 14 is permeable to the flow of liquefied petroleum gas and nominally consists of a permeable means for supporting 24 the fixed bed 22. This supporting means is analogous in function and structure to supporting means 5 in FIG. 1 previously discussed with the exception that the supporting means is directly attached to the canister rather than the pressure vessel 13. Additionally, a means for sealing the canister 21 to the pressure vessel 13 thereby preventing by-passing of liquefied petroleum gas around the fixed bed is required. In FIG. 2, the sealing means and access means are illustrated. The means for access 16 to the pressure vessel for canister removal is made possible by a bolted flange arrangement. The means for sealing are surface to surface seals between the upper flat lip 25 on the canister and the top section of the pressure vessel 26 and the lower flat lip 27 on the canister and the lower flange on the pressure vessel 28. Optionally, a gasket may be inserted between the sealing surfaces to help insure a leakproof system. The top section of the pressure vessel 26 and the lower flange 28 which provide an access means are held together by bolts 29. Other means for contacting and means for access are readily available to those possessing ordinary skill in the art.

The canister may optionally have one or more of the following which are illustrated in FIG. 2. A permeable means for containing 30 the activated carbon in the bed may be located at the open end of the canister adjacent to the second aperture 15. This means is analogous in structure and function to element 6 in FIG. 1. A filter media for filtering water and/or other particulates 31 such as rust and activated carbon may be located either between activated carbon 22 or containing means 30 if present and the second aperture 15. The filter media 31 may optionally be held in place using a means for confining 32 located between the filter media 31 and the second aperture 15. This confining means is also analogous in structure and function to element 6 in FIG. 1.

As illustrated in FIG. 2, the portion of the canister housing containing activated carbon may optionally contain baffles 33 which function to redirect gas flow and thereby insure efficient contact of the liquefied petroleum gas with the bed 22.

The canister-bearing apparatus may optionally contain a means for distributing 34 the liquefied petroleum gas prior to contacting the activated carbon 22 analogous in function and structure to that disclosed in the discussion of element 7 in the FIG. 1 apparatus. As shown in FIG. 2, this distributing means may be located across the entire cross-section of the pressure vessel between the bed support means 24 on the canister 21 and the first aperture 14 or may be located immediately upstream of the support means 24 on the canister 21 or may be combined with the support means.

The preferred orientation of the apparatus provides for bulk fluid flow through the activated carbon bed in either a vertical upward or downward direction. This orientation allows gravitation forces to help insure a uniform packing of the bed. The apparatus may optionally contain a means for supporting the apparatus in this configuration. Suitable support means include but are not limited to a minimum of three support legs attached to the perimeter of the apparatus at strategic locations, a stand on which the apparatus rests, and other means readily available to those skilled in the art.

When the oil removal efficiency of the activated carbon bed has been reduced to an unacceptable level, the activated carbon can be removed from its enclosure, that is a pressure vessel analogous to that presented in the FIG. 1 embodiment or a canister analogous to that presented in the FIG. 2 embodiment, and replaced with fresh activated carbon. In another embodiment, the entire canister assembly can be viewed as being a totally or partially expendable module and the module replaced when bed performance deteriorates.

The following examples are provided to illustrate the practice of the invention and are not intended to limit the scope of the invention or the appended claims in any way.

Example I

This example demonstrates the ability of the inventive process and apparatus to remove residual oil from liquefied petroleum gas.

The experimental tests were conducted in a 12" diameter, 5' 5 ½" long steel pressure vessel. This unit was specifically designed for use at refueling stations for vehicles powered by liquefied petroleum gas. The system was designed according to the 1989 Edition of Section VIII, Div. I and the 1991 Addenda of the ASME Code. The designed pressure and designed temperature were respectively 445 psi and 650 ° F. The vessel was situated in a vertical configuration with the liquefied petroleum gas introduced to the vessel through an inlet aperture located at the base of the vessel on the vessel axis center line. A bed support was situated 3" downstream of the inlet. The bed support was comprised of a flat plate containing 40% open areas (0.125" holes) on which was placed 16 mesh steel screen. The activated carbon bed consisting of 55 lbs of Nuchar WV-B 4×14 mesh activated charcoal (Westvaco Chemicals) was situated on the bed support. The total bed depth was approximately 59". An apparatus identical to the support screen was suspended 3" upstream of the outlet aperture. The outlet aperture was located at the top of the vessel on the reactor axis center line. The vessel volume was approximately 30 gal.

The experimental configuration consisted of two 1000 gal tanks, the above-described vessel and a positive displacement pump. Because of concerns with the possible freezing of residual moisture in the activated carbon bed resulting from the flashing of the liquefied petroleum gas into the reactor thereby both displacing air from the reactor and pressuring up the system, approximately one-half gal of anhydrous methanol was introduced to the bed prior to the introduction of liquefied petroleum gas to the system. Fluid injection was into the base of the vessel.

As shown in Table I, each flow test entailed flowing approximately 630 gal of liquefied petroleum gas at approximately 10 gal per minute from one tank, through the vessel, to a second tank. The liquefied petroleum gas was analyzed for residual oil and/or mercaptan before and after each test. The residual oil content of the treated depleted liquefied petroleum gas was increased prior to a test by adding a known amount of No. 4 fuel oil to the liquefied petroleum gas. The resulted mixture was then mixed by withdrawing liquefied petroleum gas from the tank at one location with a positive displacement pump and reinjecting the fluid back into the tank at a different location. Samples were then obtained for analyses. The No. 4 fuel oil contained 99 weight percent of $C_{10}$+ hydrocarbon components.

Presented in Table I are the results for Runs 1–7. The tests were part of a series of tests conducted sequentially on the same activated carbon bed. For differing residual oil saturations in the influent liquefied petroleum gas, the Table I test results indicate that even at these non-optimized conditions, the activated carbon can effectively remove residual oil from liquefied petroleum gas contaminated with residual oil and can achieve acceptable loadings of residual oil on the activated carbon bed.

TABLE I

Removal Efficiencies and Bed Loadings for Activated Carbon Bed

| Run | Influent Concentration [a](ppm$_w$) | LPG Volume Throughput (gal) | Removal Efficiency (%) | Bed Loading (mg/g) |
|---|---|---|---|---|
| 1 | 29.5 | 731 | 62 | 1.1 |
| 2 | 41.0 | 731 | 56 | 2.4 |
| 3 | 65.5 | 726 | 60 | 4.7 |
| 4 | 89.5 | 731 | 48 | 7.1 |
| 5 | 46.5 | 731 | 33 | 8.0 |
| 6 | 71.0 | 719 | 20 | 8.2 |
| 7 | 93.0 | 726 | 11 | 8.8 |

[a]Residual oil (No. 4 fuel oil) was added to the liquefied petroleum gas in amount sufficient to give designated concentration.

Example II

This example demonstrates that activated carbon can be pretreated with odorant such that negligible odorant removal occurs when subsequently contacted with odorant-bearing liquefied petroleum gas.

The experimental tests were conducted in the system described in Example I. Prior to these tests, the activated carbon bed was replaced with a fresh bed. The odorant used in these studies was ethyl mercaptan.

The tests were conducted by first charging the bed with liquefied petroleum gas in a manner analogous to that presented in Example I. As discussed in Example I, the loading procedure included the addition of approximately one-half gallon of anhydrous methanol immediately prior to injection of the liquefied petroleum gas. This was done to minimize the possibility of moisture freezing and thereby blocking fluid flow in the activated carbon bed. The initial loading of liquefied petroleum gas did not contain odorant. A total of 100 grams of ethyl mercaptan was added to the activated carbon bed by injection with liquefied petroleum gas. The bed was then closed off and exposed to the odorant-bearing liquefied petroleum gas for 36 hrs. The bed was then contacted with approximately 600 gal of odorant-free liquefied petroleum gas (Run No. 1) and the concentration of odorant in the bulk produced liquefied petroleum gas was then determined. As shown in Table II, essentially all odorant had been removed from the liquefied petroleum gas by the activated carbon bed following the second contacting of the bed with the liquefied petroleum gas.

An additional 100 grams of odorant (ethyl mercaptan) was then contacted with the bed in a manner analogous to the contacting with the first 100 grams of odorant. In subsequent runs, the bed was contacted with the produced odorant-bearing liquefied petroleum gas from each preceding test whereupon it was observed that the odorant concentration approached a nearly constant value indicating effective loading of activated carbon bed and thereby indicating pretreatment of activated carbon with odorant to be possible. Analysis of the bulk liquefied petroleum gas produced from Run No. 8 indicated significant concentrations of diethyl disulfide which is indicative of the oxidation of ethyl mercaptan to diethyl disulfide. This oxidation was apparently catalyzed by the activated carbon bed.

TABLE II

| | | Loading of Activated Carbon Bed with Odorant | | | |
|---|---|---|---|---|---|
| Run No. | Volume (gal) | Effluent Odorant Concentration[1] (lbs/10,000 gal) | Amount Removed (grams) | Effluent Odorant Concentration[2] (lbs/10,000 gal) | Amount Removed (grams) |
| 1[a] | 600 | 0.3 | 90.5 | 0.3 | 90.5 |
| 2 | 600 | 0.0 | 100.0 | — | — |
| 3[b] | 600 | 0.9 | 171.5 | — | — |
| 4 | 600 | — | — | — | — |
| 5 | 600 | 1.0 | 168.0 | — | — |
| 6 | 600 | 0.8 | 174.5 | 1.35 | 157.0 |
| 7 | 600 | 0.15[c] | 195.2[c] | — | — |
| 8 | 600 | 0.55 | 182.5 | 1.45, 1.35[d] | 154.0, 157.0 |

[1]Concentration estimated using stain tube technique.
[2]Concentration determined using the preferred analytical technique - Gas chromatography.
[a]Run conducted after bed contacted with 100 g ethyl mercaptan odorant.
[b]Run conducted after bed contacted with additional 100 g ethyl mercaptan odorant.
[c]Results are believed to be incorrect.
[d]Analysis of effluent indicated 65 ppm ethylene disulfide. Oxidation of mercaptan to disulfide apparently occurred. Effluent ethyl mercaptan concentration of 1.35 lb/10,000 gal corresponds to approximately 32 ppm ethylmercaptan.

Example III

An apparatus analogous to that presented in the schematic sketch of FIG. 1 was tested on a liquefied petroleum gas-powered forklift. The apparatus was comprised of a 2" diameter, 9" long pipe which was threaded externally on each end, two threaded pipe caps which were drilled center hole, tapped, and connected to inlet and outlet fuel lines, a fine mesh screen inside each pipe cap, a ⅛" thick fabric filter pad adjacent to each fine mesh screen and one pound of Westvaco Nuchar WV-B activated carbon situated between the filter pads. The flow rates through this filter were 1.5 gal/hr. Periodic review of the converter on the fork lift engine indicated the apparatus to be effective in removing residual oil present in the liquefied petroleum gas.

That which is claimed:

1. A process for removing oil from an oil-bearing liquefied petroleum gas comprising the steps of (a) removing water and air from an activated carbon wherein said removing step is comprised of:

(i) contacting at least a portion of the activated carbon with anhydrous methanol;

(ii) displacing a majority of the air from the activated carbon with a gaseous liquefied petroleum gas;

(iii) pressurizing the gaseous liquefied petroleum gas in the activated carbon to a pressure such that the liquefied petroleum gas exists stably in a liquid state; and (iv) displacing a majority of the water and methanol with liquefied petroleum gas; and (b) contacting said oil-bearing liquefied petroleum gas with activated carbon wherein air and water have been removed according to step (a).

2. A process for removing oil from an oil-bearing liquefied petroleum gas comprising the steps of (a) removing water and air from an activated carbon wherein said removing step is comprised of (i) contacting at least a portion of the activated carbon with anhydrous methanol;

(ii) displacing a majority of the air from the activated carbon with a gaseous liquefied petroleum gas;

(iii) pressurizing the gaseous liquefied petroleum gas in the activated carbon to a pressure such that the liquefied petroleum gas exists stably in a liquid state; and (iv) displacing a majority of the water and methanol with liquefied petroleum gas;

(b) flowing the oil-bearing liquefied petroleum gas into a container containing a fixed bed of activated carbon wherein air and water have been removed according to step (a);

(c) dispersing the oil-bearing liquefied petroleum gas uniformly across the cross-section of the container immediately upstream of the fixed bed;

(d) flowing the oil-beating liquefied petroleum gas into the fixed bed thereby producing a treated liquefied petroleum gas; and (e) filtering the treated liquefied petroleum gas to remove water or solid particulates from the treated liquefied petroleum gas.

3. A process for removing oil from an odorized oil-bearing liquefied petroleum gas comprising the steps of (a) removing water and air from an odorized activated carbon wherein said removing step is comprised of (i) contacting at least a portion of the odorized activated carbon with anhydrous methanol;

(ii) displacing a majority of the air from the odorized activated carbon with a gaseous liquefied petroleum gas;

(iii) pressurizing the gaseous liquefied petroleum gas in the odorized activated carbon to a pressure such that the liquefied petroleum gas exists stably in a liquid state; and (iv) displacing a majority of the water and methanol with odorized liquefied petroleum gas; and (b) contacting said odorized oil-bearing liquefied petroleum gas with activated carbon wherein air and water have been removed according to step (a).

4. A process for removing oil from an odorized oil-bearing liquefied petroleum gas wherein said odorant is ethyl mercaptan comprising the steps of (a) removing water and air from an odorized activated carbon wherein said odorant is ethyl mercaptan and wherein said removing step is comprised of (i) contacting at least a portion of the activated carbon with anhydrous methanol;

(ii) displacing a majority of the air from the activated carbon with a gaseous liquefied petroleum gas;

(iii) pressurizing the gaseous liquefied petroleum gas in the activated carbon to a pressure such that the liquefied petroleum gas exists stably in a liquid state; and (iv) displacing a majority of the water and methanol with liquefied petroleum gas;

(b) flowing the odorized oil-bearing liquefied petroleum gas into a container containing a fixed bed of activated carbon wherein air and water have been removed according to step (a) and wherein said bed is of cylindrical geometry;

(c) dispersing the odorized oil-bearing liquefied petroleum gas uniformly across the cross-section of the container immediately upstream of the fixed bed; and (d) flowing the oil-bearing liquefied petroleum gas into the fixed bed thereby producing a treated liquefied petroleum gas.

5. In a process for the removal of oil from an oil-bearing liquefied petroleum gas by activated carbon, the improvement comprises the following start-up procedure wherein water and air are removed from the activated charcoal comprising (a) contacting at least a portion of the activated carbon with anhydrous methanol;

(b) displacing a majority of the air from the activated carbon with a gaseous liquefied petroleum gas;

(c) pressurizing the gaseous liquefied petroleum gas in the activated carbon to a pressure such that the liquefied petroleum gas exists stably in a liquid state; and (d) displacing a majority of the water and methanol with liquefied petroleum gas.

* * * * *